United States Patent [19]

Thompson

[11] Patent Number: 4,753,585

[45] Date of Patent: Jun. 28, 1988

[54] PRIME MOVER WITH TOOTHED ROTORS HAVING DIFFERENT DIAMETER PORTIONS

[76] Inventor: Mark C. Thompson, 10841 Rush St., South El Monte, Calif. 91733

[21] Appl. No.: 546,966

[22] Filed: Oct. 31, 1983

[51] Int. Cl.[4] ..... F01C 1/18; F01C 19/04

[52] U.S. Cl. ..... 418/127; 418/204; 418/206

[58] Field of Search ..... 418/127, 191, 204–206

[56] References Cited

U.S. PATENT DOCUMENTS

| | | | |
|---|---|---|---|
| 81,778 | 9/1868 | Hardy | 418/127 |
| 628,906 | 7/1899 | Grindrod | 418/204 |
| 799,677 | 9/1905 | Schluter | 418/204 |

FOREIGN PATENT DOCUMENTS

| | | | |
|---|---|---|---|
| 2524280 | 12/1976 | Fed. Rep. of Germany | 418/206 |

*Primary Examiner*—John J. Vrablik

*Attorney, Agent, or Firm*—Keith D. Beecher

[57] ABSTRACT

A prime mover for transforming energy from the pressure form to the mechanical form. The prime mover comprises a pair of toothed rotors which engage one another so as to be self-timing. Each rotor has a first portion of relatively large diameter and a second portion of relatively small diameter, each of the portions extending approximately 180°. The rotors are enclosed in respective intersecting cylindrical chambers in a housing, with the tips of the teeth of the small diameter portion of each rotor being displaced radially inwardly from the peripheral surface of the corresponding chamber, and with the tips of the teeth of the large diameter portion of each rotor being directly adjacent to the inner surface of the corresponding chamber. First and second sealing members are mounted in the housing, and these engage the tips of successively passing teeth of the large diameter portion of each rotor, as the rotors turn. A drive fluid is introduced into an inlet in the housing located at the common tangent of the two rotors, and the drive fluid exits through a diametrically opposed aligned outlet.

5 Claims, 3 Drawing Sheets

PRIME MOVER WITH TOOTHED ROTORS HAVING DIFFERENT DIAMETER PORTIONS

RELATED APPLICATIONS

Abandoned application Ser. No. 255,427 filed Apr. 20, 1981 in the name of the present inventor, which abandoned prior to the filing of the present application.

BACKGROUND OF THE INVENTION

The prime mover of the present invention is predicated on generally similar operating principles as the engine illustrated and described in U.S. Pat. No. 1,614-Baker, which issued May 19, 1840. The Baker engine includes two cylindrical rotors mounted in a housing on spaced and parallel shafts, with each rotor having a 180° portion of relatively small diameter, and a 180° portion of relatively large diameter. The boundaries between the two diametric portions of each rotor form buckets against which the propelling power is applied. The cylinders are timed and maintained in a predetermined relative position by external meshing spur gears.

The Baker engine is subject to sealing problems, and also to problems which arise from the fact that the surface area of the buckets to which the propelling power is applied is necessarily small. It is necessary in the Baker type of engine that the two rotors be properly sealed with respect to one another, but this is difficult with the Baker construction. In the Baker engine, the pressure between the inlet and outlet tends to force the rotors apart to cause leakage.

The prime mover of the present invention overcomes the problems inherent in the Baker engine by providing toothed rotors which eliminates any need for separate external timing gears, and which also provides a relatively large working surface against which the propelling power is applied. The toothed rotors of the prime mover of the present invention may be readily sealed to the internal surfaces of the housing, which is essential for the proper operation of the mechanism. In addition, the toothed rotors of the prime mover of the invention provide for a tight seal between the rotors which, as mentioned above, is not the case in the Baker engine, and which is essential for the efficient operation of the mechanism.

In the prime mover of the invention, the seal between the rotors is such that the inlet pressure does not tend to force the rotors apart, since the rotors are always pressing against one another even in the presence of a high inlet pressure. The complete seal between the rotors in the mechanism of the present invention is provided due to the fact that the teeth on the rotors are such that there always exists three separate surfaces in physical contact with one another between the rotors as the rotors rotate. Also, the toothed construction of the rotors provides a relatively large surface area against which the propelling power is applied.

It is, accordingly, an objective of the present invention to provide an improved and highly efficient prime mover which is simple, rugged and economical in its construction, and which is capable of converting, for example, inlet pressure differentials into mechanical power on a highly efficient and economical basis.

It is to be understood, of course, that although the mechanism of the invention is intended generally for use as a prime mover, its operation could be reversed, and the mechanism could be used for pumping fluids, which may be either gases or liquids.

DETAILED DESCRIPTION OF THE ILLUSTRATED EMBODIMENT

Figure 3:
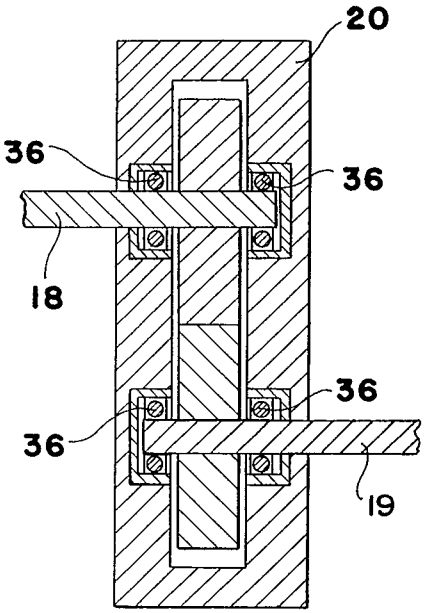
FIG. 3 is a further cross-section of the unit, taken at 90° to the cross-section of FIG. 2, and showing bearing means in which the rotor shafts of the unit are supported.
Figure 5:
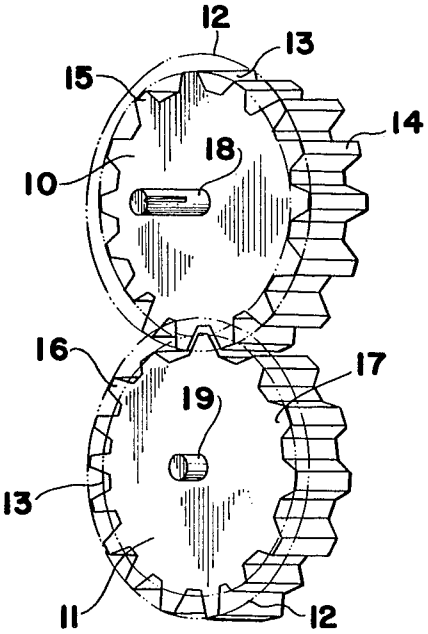
FIG. 5 is a perspective representation of a pair of toothed rotors which are incorporated into the unit of FIGS. 1-3.

The prime mover of the illustrated embodiment of the invention includes a pair of rotors 10 and 11 (FIGS. 3 and 5). Each rotor has two outside diameters indicated by the broken circles 12 and 13, such that each rotor has a large diameter portion extending about 180°, and each has a small diameter portion likewise extending about 180°. Rotor 10 in the illustrated embodiment has eight teeth on its large diameter portion indicated by reference character 14, and seven teeth on its small diameter portion indicated by reference character 15. Similarly, rotor 11 has eight teeth 16 on its large diameter portion, and seven teeth 17 on its small diameter portion.

A shaft 18 extends through housing 20, and this shaft serves to support rotor 10. A shaft 19 is rotatably mounted in the housing, and it extends through the opposite side of the housing. Shaft 19 serves to support rotor 11.

Figure 2:
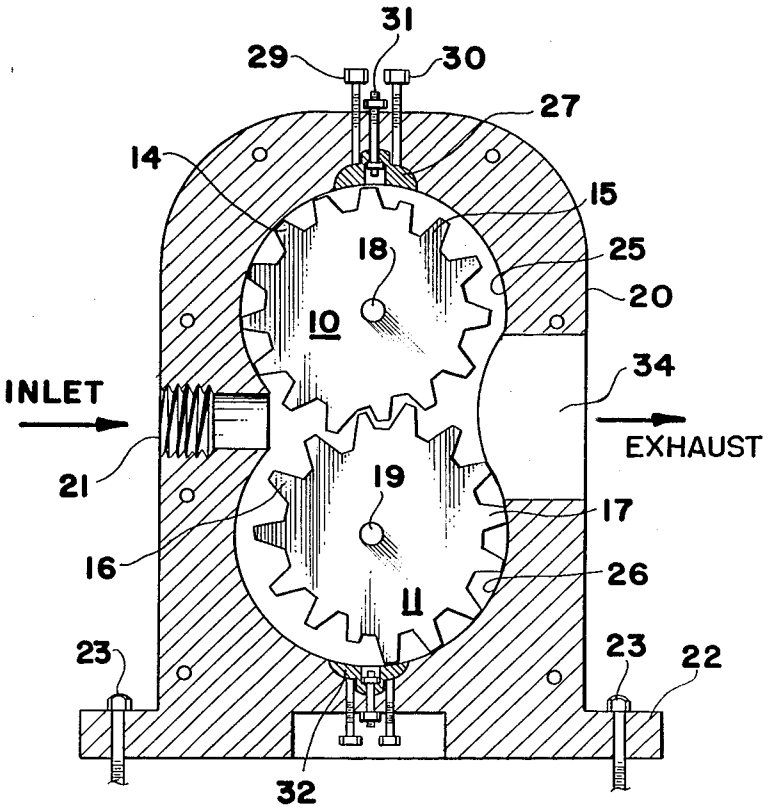
FIG. 2 is a cross-section of the mechanism of FIG. 1 taken essentially along the lines 2—2 of FIG. 1.
Figure 1:
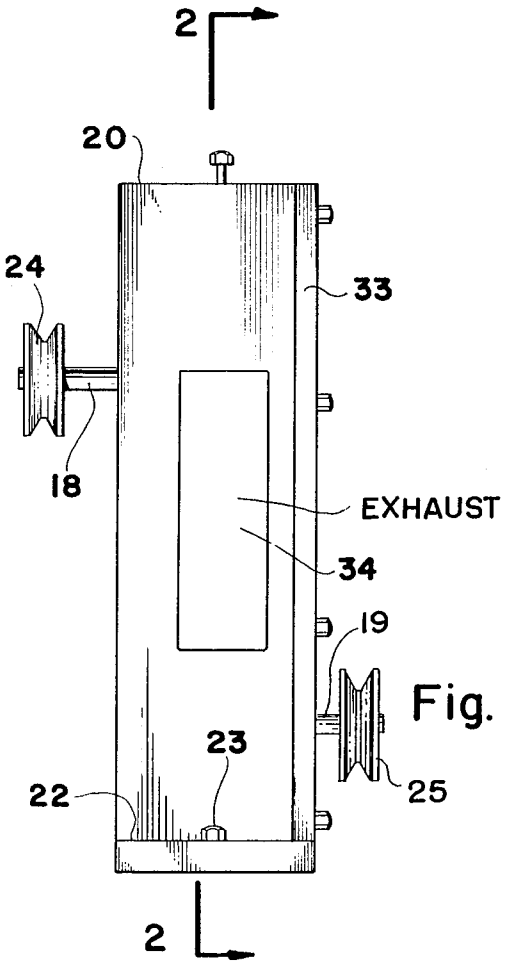
FIG. 1 is a side elevational view of a prime mover constructed in accordance with one embodiment of the invention.

The rotors may be fabricated from steel or other metal selected with considerations such as corrosion resistance to the fluid being introduced to the prime mover, wear resistance, ease of fabrication, and the like. The particular selection of materials of construction is conventional keeping these considerations in mind. As shown in FIG. 1 shaft 18 of rotor 10 extends through housing 20, as mentioned above. An inlet opening 21 is formed in the side of housing 20, as best shown in FIG. 2, the inlet opening having a threaded portion for inserting a pipe or other conduit into the housing. An exhaust opening 34 is also formed in the opposite side of housing 20. The inlet opening 21 and exhaust opening 34 are aligned with one another, as shown in FIG. 2, and are positioned at the tangent line between the rotors 10 and 11. The exhaust opening is relatively large to prevent any build up of back pressure. Housing 20 has a base member 22 which may be secured to the supporting surface by bolts, such as bolts 23. A pulley 24 is attached to the end of shaft 18, as shown in FIG. 1. A pulley 25 is attached to the end of shaft 19. The pulleys may be coupled to any appropriate loads, such as an hydraulic pump, an electric generator, or the like.

Housing 20 is shown in cross-sectional view in FIG. 2, which also illustrates rotors 10 and 11 mounted on shafts 18 and 19. A pair of intersecting cylindrical chambers 25 and 26 are formed in the housing 20, and rotors 10 and 11 are rotatably supported within the respective chambers. The inner peripheral surfaces of the respective chambers 25 and 26 are directly adjacent to the teeth 14 and 17 on the large diameter portions of rotors 10 and 11, as shown.

A seal 27 for rotor 10 is mounted on the inner peripheral surface of chamber 25 of housing 20. Seal 27 may be a bearing formed of graphite, bronze, or other low friction sealing material. The seal is positioned by three adjusting nuts on bolts 29, 30 and 31. Nuts on bolts 29 and 30 force the seal 27 downwardly into contact with the tips of the successive teeth 14 on the large diameter portion of rotor 10, as the rotor rotates, and also serve to orient the seal 27 with respect to these teeth of rotor 10. Bolt 31 holds seal 27 up when the teeth 15 on the small diameter portion of rotor 10 pass under the seal. A similar seal 32 is mounted in chamber 26 for engaging the tips of teeth 17 on the large diameter portion of rotor 11. Seals 27 and 32 represent but one possible type of seal that may be used in the unit. It is evident that other known types of seals may be used in order to form an effective seal between the tips of the teeth on the large diameter portions of the rotors and the inner peripheral surfaces of the chambers in the housing. An access plate 33 is bolted to one side of housing 20, as shown in FIG. 1.

Figure 4:
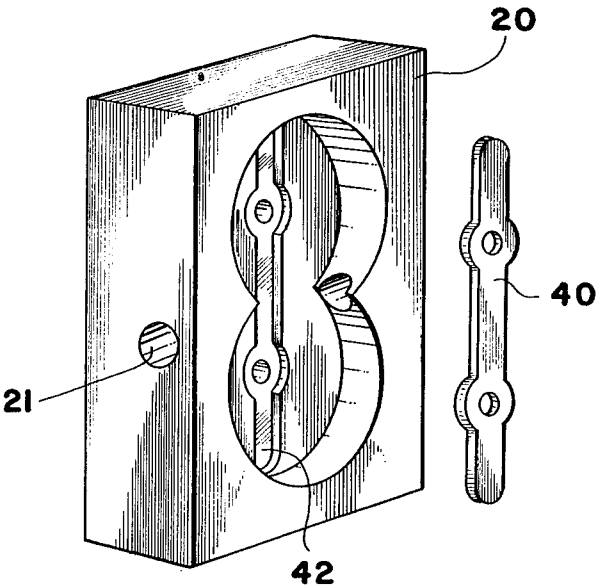
FIG. 4 is a perspective view of the housing of the unit of FIG. 1, and various components of the housing.

The rotors 10 and 11 are preferably held in bearings such as roller bearings 36 shown in FIG. 3. Shaft 18 should be sealed to prevent or reduce fluid leakage from the housing. The seals used for this purpose may be conventional depending upon the nature of the fluid being introduced to the prime mover. A particularly effective seal is shown in FIG. 4, in which a heat treated graphite seal 40 is shaped to fit into a recess 42 in housing 20. A similar seal may be placed in a recess in access plate 33.

One embodiment of the prime mover of the present invention was constructed utilizing a two inch pitch diameter on the large diameter portion of each rotor, and a lesser pitch diameter on the small diameter portion of each rotor. The rotors were fabricated from low carbon steel, and bearing bronze was used along the shaft of each rotor. No side seals were used in the illustrated embodiment, although in commercial operation a side seal along each side of each rotor would be preferable.

Figure 6:
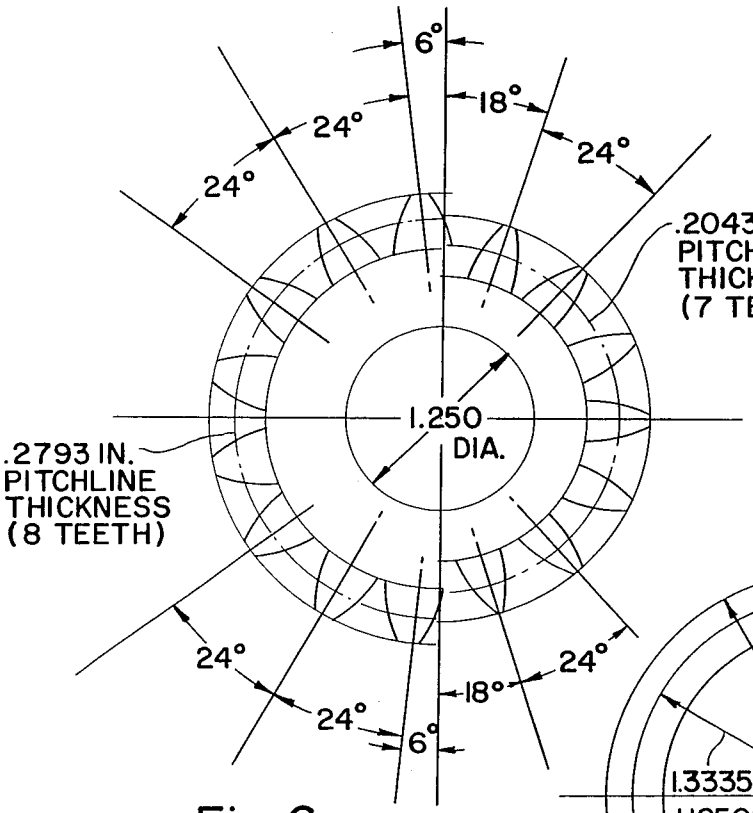
FIGS. 6 and 7 are schematic representations showing the dimensions of a typical rotor used in a preferred embodiment of the invention.
Figure 7:
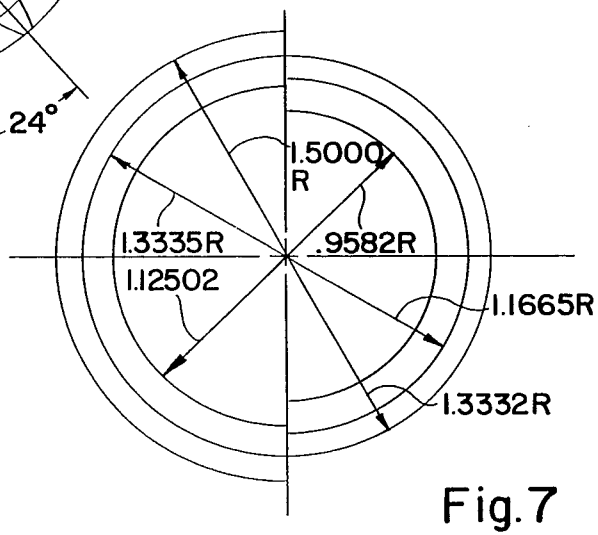

Rotor and rotor teeth dimensions of the preferred embodiment are shown in FIGS. 6 and 7. The illustrated depth of the tooth construction plus the difference in the pitch diameters and the width of the teeth produce the pressure face upon which the pressure media acts to produce work at the rotor shafts. The illustrated teeth are of involute construction which serves to provide a positive mechanical seal at the point where the gears mesh on the vertical center-line of the section shown in FIG. 2.

Although an eight-tooth-seven-tooth configuration is shown in FIGS. 2 and 5, a larger or smaller number of teeth may be used for each rotor. Moreover, the teeth may be rounded or relatively squared. Furthermore, there may be an even number of teeth or an odd number of teeth for each diameter portion for each rotor. When an even number of teeth are used, it is preferable that the last tooth on the large diameter portion of each rotor be radially cut in half. In the event there are an odd number of teeth, it is not necessary to cut any of the gear teeth in half.

The operation of the prime mover of the invention may best be understood by reference to FIG. 2. As pressurized fluid is introduced through the inlet 21, it moves down into the space between the teeth 16 and the inner surface of chamber 26 when the rotors are in the position illustrated in FIG. 2. The pressurized fluid moves against the rear tooth 17, causing the rotor 11 to turn in a counterclockwise direction. During this drive on rotor 11, rotor 10 is freely rotatable, and turns in a clockwise direction.

After the last tooth 17 of rotor 11 moves passed seal 32, rotor 11 becomes freely rotatable, and the pressurized fluid from opening 21 is forced against the rear tooth 14 on the large diameter portion of rotor 10, causing the rotor 10 to rotate in a clockwise direction, as the tips of the teeth 14 are sealed by seal 27.

Accordingly, the rotors 10 and 11 rotate at high speed in opposite directions, with the pressurized inlet fluid flowing around the spaces between the teeth 15 and 16 on the small diameter portions of the rotors and through outlet 34.

The invention provides, therefore, a prime mover which comprises a housing having two intersecting cylindrical chambers, and a pair of toothed rotors rotatably mounted in the housing and positioned in the respective chambers, with each rotor having a large diameter portion and a small diameter portion. The tips of the teeth on the large diameter portion of each rotor form a seal with the inner surface of the corresponding chamber at at least one point. In addition, the teeth of the rotors mesh together to serve as a seal between the rotors, and the teeth also serve to retain the rotors in a proper timed relationship with one another.

The prime mover of the invention features a positive displacement non-reciprocating rotating gear approach in an efficient, inexpensive and rugged unit which can operate over a wide range of inlet/outlet pressure differentials with many working fluids. The prime mover of the invention may be directly coupled to other rotating equipment, which may be, for example, electric generators, compressors, hydraulic pumps, water pumps, and the like. Therefore, either electrical work or direct shaft work can be produced by the prime mover of the invention.

It will be appreciated that while a particular embodiment of the invention has been shown and described, modifications may be made. It is intended in the claims to cover all modifications which come within the true spirit and scope of the invention.

What is claimed is:

1. A prime mover or pump comprising: a housing having two intersecting cylindrical chambers formed therein, and having an inlet conduit and an outlet conduit; a pair of toothed rotors mounted in the respective cylindrical chamber of said housing for rotation about spaced and parallel axes, with the teeth of one rotor meshing with the teeth of the other rotor at the intersection of the chambers, and the teeth on the rotors being of an involute construction to provide a positive mechanical seal between the two rotors, and each rotor having a fixed large diameter portion and a fixed smaller diameter portion, with the tips of the teeth of the large diameter portion of each of the rotors extending into close proximity with the inner surface of the housing at at least one point on the inner peripheral surface of each of the cylindrical chambers, and with the meshing teeth of the rotors forming a seal between the rotors, said inlet and outlet conduits being aligned with one another on opposite sides of the housing along the tagent line between the rotors at the intersection of the cylindrical chambers, and which includes two sealing members mounted on the housing in respective positions on the inner peripheral surface of the respective cylindrical chambers to engage the tips of the teeth of the large diameter portions of the respective rotors as the rotors rotate.

2. The prime mover or pump defined in claim 1, in which approximately 180° of each rotor constitutes the large diameter portion, and approximately 180° of each rotor constitutes the small diameter portion.

3. The prime mover or pump defined in claim 1, in which each rotor has eight teeth formed on the large diameter portion thereof and seven teeth formed on the small diameter portion thereof.

4. The prime mover or pump defined in claim 1, and which includes a pair of axial shafts mounted in said housing for rotatably supporting the respective rotors.

5. The prime mover or pump defined in claim 4, in which one of said axial shafts extends through the housing, and which includes a pulley affixed to said last-named axial shaft external to the housing.

* * * * *